US010120317B2

(12) United States Patent
Fukuda et al.

(10) Patent No.: US 10,120,317 B2
(45) Date of Patent: Nov. 6, 2018

(54) IMAGE FORMING APPARATUS

(71) Applicant: CANON KABUSHIKI KAISHA, Tokyo (JP)

(72) Inventors: Takeshi Fukuda, Nagareyama (JP); Keisuke Yoshida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/724,496

(22) Filed: Oct. 4, 2017

(65) Prior Publication Data

US 2018/0101116 A1 Apr. 12, 2018

(30) Foreign Application Priority Data

Oct. 11, 2016 (JP) ..... 2016-200027
Jul. 28, 2017 (JP) ..... 2017-146382

(51) Int. Cl.
*G03G 15/20* (2006.01)
*G03G 15/00* (2006.01)

(52) U.S. Cl.
CPC ..... *G03G 15/607* (2013.01); *G03G 15/2028* (2013.01)

(58) Field of Classification Search
CPC ..... G03G 15/607; G03G 15/2028
USPC ..... 399/45
See application file for complete search history.

(56) References Cited

U.S. PATENT DOCUMENTS 6,002,891 A * 12/1999 Shin ..... G03G 15/167 399/308
8,078,073 B2 12/2011 Kinouchi et al.
9,715,199 B2 7/2017 Yoshida et al.
2008/0118262 A1 5/2008 Kinouchi et al.
2010/0196041 A1 8/2010 Otaki
2013/0051824 A1* 2/2013 Bobo ..... G03G 15/2032 399/45

(Continued)

FOREIGN PATENT DOCUMENTS

JP 10-308833 A 11/1998
JP 2004-325665 A 11/2004
JP 2005-062491 A 3/2005

(Continued)

OTHER PUBLICATIONS

U.S. Appl. No. 15/724,507, filed Oct. 4, 2017, Keisuke Yoshida Takeshi Fukuda.

(Continued)

*Primary Examiner* — Susan Lee
(74) *Attorney, Agent, or Firm* — Fitzpatrick, Cella, Harper & Scinto

(57) ABSTRACT

An image forming apparatus is operable in a first mode in which a control unit is in a rest state and a second mode in which electric power is supplied to the control unit. The image forming apparatus changes the mode of the operation to the second mode of the operation in response to detection of putting of the sheet on the manual feeding tray during execution of the operation in the first mode with the pressing mechanism being in the second position, and then in response to receipt of input of a predetermined instruction about an image forming operation by a receiving portion in the second mode, the control unit controls the moving mechanism so that the pressing mechanism moves from the low pressure position to a nip-forming position.

10 Claims, 15 Drawing Sheets

(56) References Cited

U.S. PATENT DOCUMENTS

2015/0248156 A1 9/2015 Haraguchi

FOREIGN PATENT DOCUMENTS

| | | | |
|---|---|---|---|
| JP | 2008-129581 | A | 6/2008 |
| JP | 2015-164789 | A | 9/2015 |
| JP | 2016-018128 | A | 2/2016 |

OTHER PUBLICATIONS

Japanese Office Action dated Aug. 28, 2018, in Japanese Patent Application No. 2017-146382.

* cited by examiner

THE OTHER SIDE
(NON-DRIVING SIDE)

IMAGE FORMING APPARATUS

FIELD OF THE INVENTION AND RELATED ART

The present invention relates to an image forming apparatus, such as a copying machine, a printer or a facsimile machine, which employs, for example, an electrophotographic type and which is capable of forming an image on a recording material.

In the image forming apparatus using the electrophotographic type of a transfer type, a latent image formed on a photosensitive drum as an image bearing member is developed with toner (developer) into a toner image (visible image), and the toner image is transferred onto the recording material (hereinafter referred to as a sheet or paper) by using an electrostatic force and pressure. Then, the transferred toner image is fixed under application of heat and pressure by a fixing device as an image heating apparatus, whereby the image is recorded and formed on the sheet.

As a type of the fixing device, a roller fixing type in which a fixing nip is formed by pressing or press-contacting an elastic pressing roller to a fixing roller, including a heater, with a pressing lever for stretching a pressing spring and in which a sheet on which a toner image is carried is nipped and fed through the fixing nip and thus the toner image is fixed on the sheet has been conventionally employed.

Further, for the purpose of suppressing plastic deformation or the like of an elastic layer of the pressing roller due to maintaining a press-contact state between the fixing roller and the pressing roller, a pressing type, in which a pressure-releasing mechanism for releasing (eliminating) pressure by operating the pressing lever and thus by retracting the pressing roller from the fixing roller is provided, has been used. In recent years, for the purpose of saving energy in consideration of an environment, during non-image formation of the image forming apparatus, a change in operation mode of an image forming apparatus main assembly to a low electric power mode has been carried out.

In the change to the low electric power mode, a pressure-releasing operation of the fixing device has been performed in combination therewith. Restoration from the low electric power mode to an image forming state has required that the image forming apparatus be placed in a stand-by state more quickly with speed-up of the restoration in recent years, and during the restoration, also a pressing operation of the fixing device has been performed.

For example, as disclosed in Japanese Laid-Open Patent Application (JP-A) Hei 10-308833, an apparatus which is a multi-function machine operable in the low electric power mode and in which an entirety of the apparatus always including the fixing device during the restoration from the low electric power mode is actuated has been proposed.

When the number of times of the change to the low electric power mode increases, the number of times of an actuation (rising) operation during the restoration also increases, with the result that the number of times of the pressure-releasing operation increases and has the influence on a lifetime of the fixing device, and therefore, a technique of reducing the number of times of the pressure-releasing operation of the fixing device has been employed.

Further, as a proposal for reducing the number of times of pressure switching operation, as disclosed in JP-A 2016-18128, when a jam occurs, a length of paper (sheet) sandwiched in the fixing nip is calculated and on the basis of a calculation result, whether or not a pressure-reducing operation (pressure-releasing operation) is carried out is determined. As a result, the number of times of the pressure-reducing operation (pressure-releasing operation) is decreased. Such an apparatus has been proposed.

Incidentally, as disclosed in JP-A Hei 10-308833, when the fixing device is actuated simultaneously with the restoration of the image forming apparatus from the low electric power mode, there is a liability in some cases that the fixing device is uselessly actuated even in such a situation that there is originally no need to actuate the fixing device. Further, as disclosed in JP-A 2016-18128, although the number of times of the pressure-reducing operation (pressure-releasing operation) is reduced, this is limited to the time when the jam generates, so that JP-A 2016-18128 does not disclose the restoration from the low electric power mode. For that reason, there is a liability that a useless press-contact operation is performed during the restoration from the low electric power mode. As a result, there was a liability that the numbers of times of the press-contact operation and the pressure-releasing operation uselessly increased and led to deterioration of a pressing mechanism portion and a pressure-releasing mechanism portion.

SUMMARY OF THE INVENTION

The present invention has been accomplished in view of the above-described prior art. A principal object of the present invention is to provide an image forming apparatus capable of reducing the number of times of a useless press-contact operation in a fixing device.

According to an aspect of the present invention, there is provided an image forming apparatus comprising: a manual feeding tray; a detecting portion configured to detect whether or not a sheet is put on the manual feeding tray; an image forming portion configured to form an image on the sheet fed from the manual feeding tray; a first rotatable member; a second rotatable member configured to form a nip, for fixing the image on the sheet, in cooperation with the first rotatable member; a pressing mechanism configured to press the first rotatable member toward the second rotatable member; a moving mechanism configured to move the pressing mechanism between a first position where the nip is formed by the first and second rotatable members and a second position where a force applied between the first and second rotatable members by the pressing mechanism is smaller than that when the pressing mechanism is in the first position; a control unit configured to control an operation of the moving mechanism; and a receiving portion configured to receive input of an instruction about an image forming operation for forming the image on the sheet by the image forming portion, wherein the image forming apparatus is capable of selectively executing one of operations in a plurality of modes including a first mode in which the control unit is in a rest state and a second mode in which electric power is supplied to the control unit, and wherein the image forming apparatus changes the mode of the operation to the second mode of the operation in response to detection of putting of the sheet on the manual feeding tray during execution of the operation in the first mode with the pressing mechanism being in the second position, and then in response to receipt of input of a predetermined instruction about the image forming operation by the receiving portion during execution of the operation in the second mode, the control unit controls the moving mechanism so that the pressing mechanism moves from the second position to the first position.

According to another aspect of the present invention, there is provided an image forming apparatus comprising: a manual feeding tray; a detecting portion configured to detect whether or not a sheet is put on the manual feeding tray; an image forming portion configured to form an image on the sheet fed from the manual feeding tray; a first rotatable member; a second rotatable member configured to form a nip, for fixing the image on the sheet, in cooperation with the first rotatable member; a pressing mechanism configured to press the first rotatable member toward the second rotatable member; a moving mechanism configured to move the pressing mechanism so that the pressing mechanism is movable between a first position where the nip is formed by the first and second rotatable members and a second position where the first and second rotatable members are spaced from each other; a control unit configured to control an operation of the moving mechanism; and a receiving portion configured to receive input of an instruction about an image forming operation for forming the image on the sheet by the image forming portion, wherein the image forming apparatus is capable of selectively executing one of operations in a plurality of modes including a first mode in which the control unit is in a rest state and a second mode in which electric power is supplied to the control unit, and wherein the image forming apparatus changes the mode of the operation to the second mode of the operation in response to detection of putting of the sheet on the manual feeding tray during execution of the operation in the first mode with the pressing mechanism being in the second position, and then in response to receipt of input of a predetermined instruction about the image forming operation by the receiving portion during execution of the operation in the second mode, the control unit controls the moving mechanism so that the pressing mechanism moves from the second position to the first position.

Further features of the present invention will become apparent from the following description of exemplary embodiments with reference to the attached drawings.

DESCRIPTION OF EMBODIMENTS

Embodiments of the present invention will be described with reference to the drawings, but the present invention is not limited to the following embodiments.

Embodiment

[Image Forming Apparatus]

Figure 1:
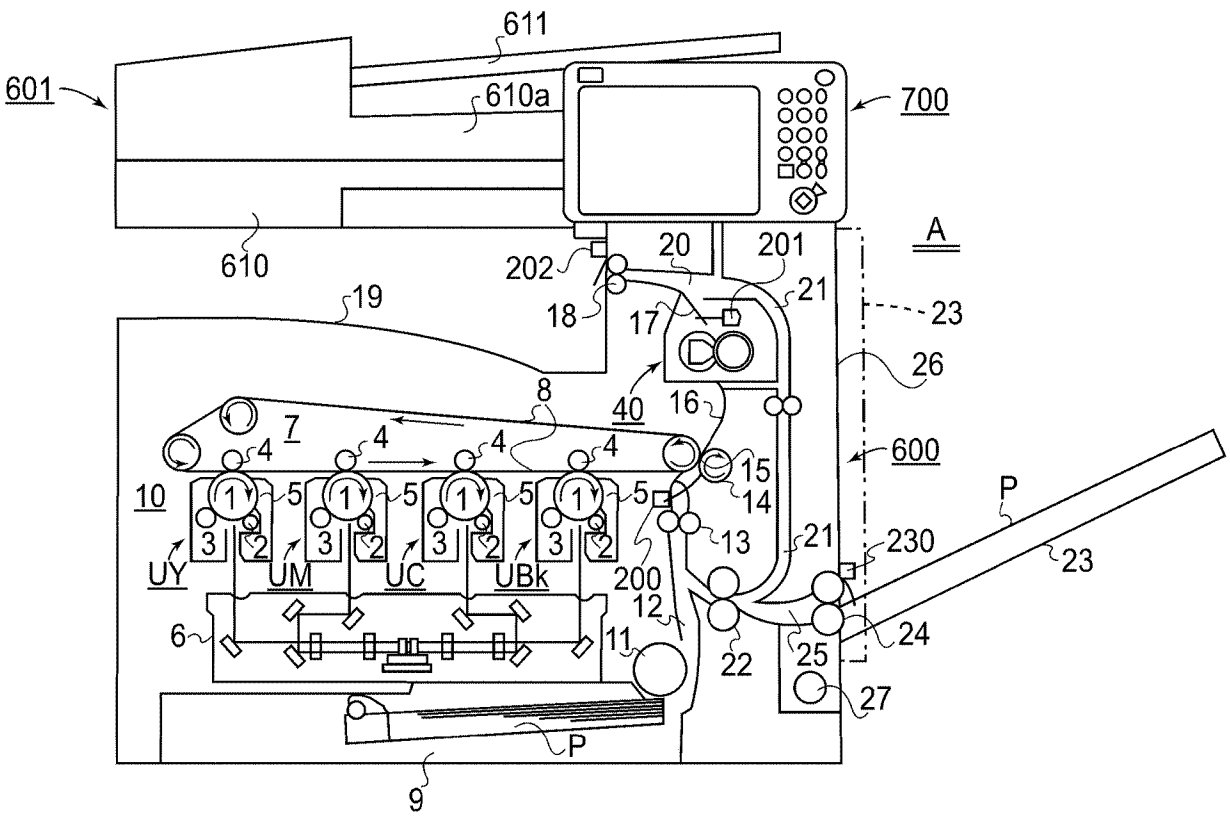
FIG. 1 is a schematic view of an image forming apparatus in an embodiment.

FIG. 1 is a schematic view of an image forming apparatus A in this embodiment. The image forming apparatus A is a tandem digital color copying machine A (hereinafter simply referred to as a copying machine A) of an electrophotographic type using a transfer type. FIG. 1 shows a schematic structure of the copying machine A in cross section along a feeding direction of a recording material (sheet) P. On the recording material (hereinafter referred to as a sheet or paper) P, a toner image is to be formed. Specific examples of the sheet P may include plain paper, a resin-mode sheet-shaped material which is a substitute for the plain paper, thick paper, a sheet for an overhead projection, and the like.

In the following, a principal constitution (structure) of the copying machine A will be described with reference to FIGS. 1 to 4. The copying machine A includes an engine portion (apparatus main assembly) 600 for forming the toner image on the sheet P and an image reading portion 601, provided on (above) the engine portion 600, for reading an image of an original. Further, at a front surface of the copying machine A, an operating portion 700 for operating the copying machine A is provided at a substantially intermediary position between the engine portion 600 and the image reading portion 601. Further, in a rear side of the engine portion 600, a control unit (controller) 800 (FIG. 13) for controlling operations of the engine portion 600 and the image reading portion 601 is provided. FIG. 1 is the schematic view of the copying machine A as seen from a front side, and as regards the engine portion 600, an inside structure of the engine portion 600 is illustrated.

Figure 2:
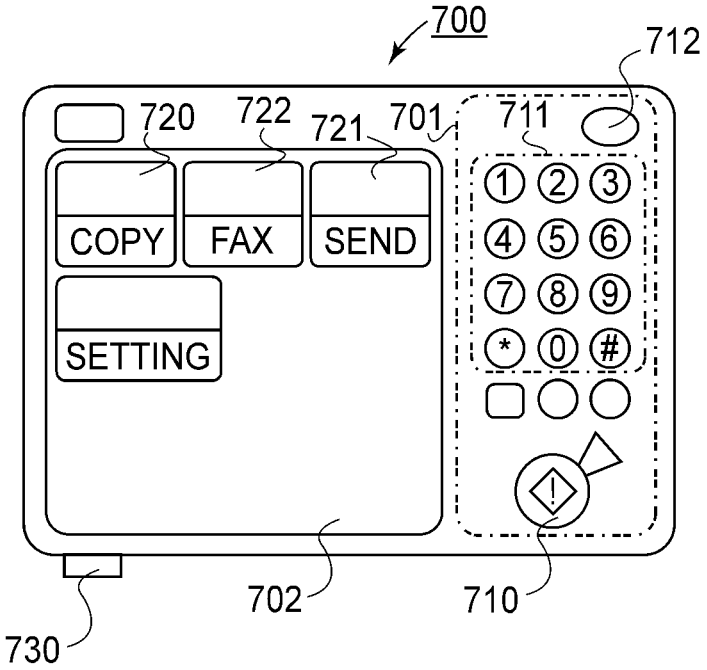
FIG. 2 is an enlarged view of an operating portion.

FIG. 2 is an enlarged schematic view of the operating portion 700. The operating portion (receiving portion) 700 includes operating buttons 701 to be operated for operating the copying machine A and a touch panel (display portion) 702 capable of displaying information and of performing operations.

The operating buttons 701 include a copy start button (original reading start button) 710, ten-key buttons 711, a low electric power mode button 712, and the like. The copy start button 710 is a button for starting a copying operation (copy operation) in which an image of an original is read by the image reading portion 601 and then is formed on the sheet P by an image forming portion 10. On the touch panel 702, buttons capable of being operated on a screen (setting screen for original copying) are displayed. For example, a copy button 720 for making setting for copying, a scan(ning) button 721 for transferring a read image, a facsimile button 722 for performing an operation such as facsimile transmission, and the like are displayed. The respective buttons are capable of being pressed by an operator, so that a function corresponding to the pressed button is performed. That is, each of the buttons is a button for performing an associated function by being pressed by the operator. That is, the copying machine A includes the operating portion 700 which has a copying function for reading the image from the original and then for forming the image, read from the original, on the sheet and which is capable of inputting an instruction of the original reading.

Further, the operating portion 700 is provided with a human sensor 730. That is, in a main assembly of the copying machine (image forming apparatus) A, the human sensor 730 is mounted. The human sensor 730 uses a sensor of an infrared radiation type, and when a heat-sensitive body crosses infrared rays (radiation), a detection signal is outputted. In this embodiment, in response to detection, by the human sensor 730, of a human as the heat-sensitive body approaching the copying machine A, i.e., on the basis of human detection by the human sensor 730, control contents of the controller 800 change as described below. In this embodiment, a temperature change detecting type using the infrared radiation is employed, but a constitution of the human sensor 730 is not limited thereto. A sensor of any type may also be used when the sensor is capable of detecting the human.

Figure 3:
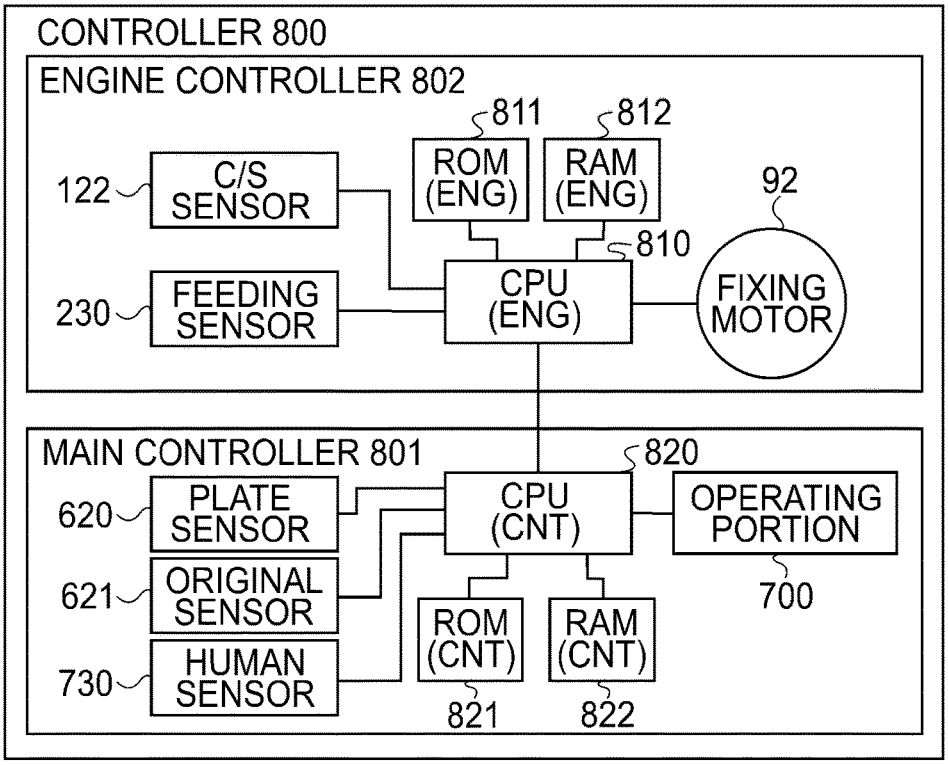
FIG. 3 is a block diagram of a control unit (controller).

As shown in FIG. 3, the controller 800 includes an engine controller 802 principally relating to image formation of the engine portion 600 and a main controller 801 for carrying out control of an entirety of the copying machine A and control of the image reading portion 601.

The engine controller 802 includes a CPU(ENG) 810 as a control means for controlling an image forming operation. The engine controller 802 further includes a ROM(ENG) 811 storing, in advance, a program executed by the CPU (ENG) 810 and a RAM(ENG) 812 storing variables and the like of the program executed by the CPU(ENG) 810.

In the ROM(ENG) 811, as an image forming condition, a size and a kind of the sheet P, an image forming color mode and an image forming mode as to whether the image is formed on one surface (side) or double surfaces (sides) are stored. Further, a control condition table for selectively deriving the image forming condition on the basis of a detection result from a temperature/humidity detecting member (not shown) or a roller temperature detecting member (not shown) or the like, a control condition such as the number of rotations of a motor depending on the image forming mode, and the like are stored. In the RAM(ENG) 812, of the control conditions stored in the ROM(ENG) 811, conditions necessary to be changed by a user (operator) or by maintenance, and variables and operation (arithmetic computation) values which are used in various pieces of control are stored, and setting values rewritable depending on a situation are stored.

The main controller 801 includes a CPU(CNT) 820 as a control means for effecting control of an entirety of the copying machine A, control of image reading and control of the operating portion 700. That is, the CPU(CNT) 820 functions as a display controller for controlling display of the touch panel 702 in the operating portion 700. The main controller 801 further includes a ROM(CNT) 821 storing, in advance, a program executed by the CPU(CNT) 820 and a ROM(CNT) 822 storing variables and the like of the program executed by the CPU(CNT) 820.

In the ROM(CNT) 821, as conditions for controlling the operating portion 700 and the image reading portion 601, control and setting conditions of a copying operation, control and setting conditions of image reading, control and setting conditions of transmission and reception of the facsimile machine, and the like are stored.

In the RAM(CNT) 822, of the control conditions stored in the ROM(CNT) 821, conditions necessary to be changed by the user (operator) or by maintenance, and variables and operation (arithmetic computation) values which are used in various pieces of control are stored, and setting values rewritable depending on a situation are stored. Further, in the ROM(ENG) 811 and the ROM(ENG) 812, conditions of an image forming mode M1 which is a principal operation mode of the engine portion 600, a stand-by mode M2, a post-restoration mode M3 from a low electric power mode, and a low electric power mode M4 are stored.

The image forming mode M1 is a mode such that the engine portion 600 is in an image formable state and the image reading portion 601 is in an image readable state. The stand-by mode M2 is a mode such that the engine portion 600 is in a preparation state of image formation and the image reading portion 601 is in the image readable state. The post-restoration mode M3 from the low electric power mode is a mode such that the fixing device 40 is in a rest state, portions other than those relating to the fixing device 40 are in the preparation state of image formation, and the image reading portion 601 is in the image readable state. The low electric power mode M4 is a mode such that the engine portion 600 and the image reading portion 601 are in the rest state for electric power reduction. As described later, the copying machine A is capable of selectively executing these modes.

The low electric power mode M4 is a mode in which the CPU(CNT) 820 of the main controller 801 is in an operable state and the CPU(ENG) 810 of the engine controller 802 is in the rest state (electric power supply: OFF) and thus is in an all-night operation mode while lowering operating electric power.

The image reading portion 601 is constituted by, as an original reading means, an original carriage (platen) 610 for reading an original on a single sheet and an automatic original feeder (device for automatically feeding originals to an original reading portion, hereinafter referred to as a "ADF" (automatic document feeder)) 611 for reading originals on many sheets.

The original carriage 610 is an image reading portion for reading a single image and is used for reading a single original or an image on a back or the like. Principally, the original carriage 610 is constituted by an original carrying reading portion (not shown) and a pressing plate portion (not shown). The original is put on the original carriage reading portion (not shown), and the user (operator) presses the copy start button 710 of the operating portion 700 or presses the scan button 721 of the touch panel 702 while pressing the original with the pressing plate portion (not shown). As a result, image reading is carried out at the original carriage reading portion (not shown). Further, the pressing plate portion (not shown) is openable (capable of being opened and closed) and is provided with a pressing plate sensor 620 for detecting an opening/closing state thereof.

The ADF 611 is used for reading the image while automatically feeding the original and is capable of continuously reading a plurality of (sheets of) originals. The ADF 611 is principally constituted by an ADF reading portion (not shown) and an original feeding portion (not shown), and the user (operator) presses the control start button 710 of the operating portion 700 or presses the scan button 721 of the touch panel 702. As a result, the image reading is carried out at the ADF reading portion (not shown) while automatically feeding the originals. Further, the original feeding portion (not shown) is provided with an original detecting sensor 621 for detecting a presence/absence state of the original.

In the original reading operation, the image is read by the original carriage 610 or the ADF 611, and image data thereof is converted to an electric signal, and then the electric signal is transmitted to a laser scanner 6 of the engine portion 600.

The engine portion 600 includes the image forming portion 10 for forming toner images. The image forming portion 10 includes an image forming unit UY for forming a toner image of yellow (Y), an image forming unit UM for forming a toner image of magenta (M), an image forming unit UC for forming a toner image of cyan (C) and an image forming unit UBk for forming a toner image of black (Bk). Further, the engine portion 600 includes the laser scanner unit 6 and an intermediary transfer belt unit 7. Each of the image forming units U is an electrophotographic process mechanism and includes a photosensitive drum 1, a charger 2, a developing device 3, a primary transfer charger 4 and a drum cleaner 5.

An electrophotographic process and an actuating operation of the image forming portion 10 having the above-described constitution are well known, and therefore will be omitted from description. The respective color toner images are primary-transferred superposedly from the respective drums 1 of the respective image forming units U onto a rotating belt 8 of the intermediary transfer belt unit 7 in a predetermined manner. As a result, on the belt 8, a color toner image consisting of the superposed toner images of four colors of Y+M+C+Bk is formed.

On the other hand, a sheet (paper) feeding roller 11 of a cassette sheet feeding portion is driven at predetermined control timing, so that the sheets P stacked and accommodated in a sheet (paper) feeding cassette 9 are fed one by one, and the fed sheet is passed through a post-sheet feeding path 12 and is sent between a registration roller pair 13. The registration roller pair 13 once receives the sheet P, and in the case where the sheet P moves obliquely, the registration roller pair 13 corrects the sheet P so as to move straightly. Then, the registration roller pair 13 sends the sheet P to a secondary transfer portion 15 which is a press-contact nip between the belt 8 and a secondary transfer roller 14 while synchronizing the sheet P with the toner image on the belt 8. The color toner image on the belt 8 is secondary-transferred by the secondary transfer roller 14 onto the sheet P in a collective manner of the four color toner images.

The sheet P passed through the secondary transfer portion 15 passes through a pre-fixing feeding path 16 and is introduced into the fixing device 40. The sheet P is fed to the fixing device (fixing portion) 40 and is heated and pressed by the fixing device 40, so that the toner image is fixed on the sheet P.

In the case of one-surface (side) image forming mode such that the toner image is formed (printed) on only one surface (side) of the sheet P, the sheet P fed upwardly from an upward exit of the fixing device 40 is guided toward a discharge roller pair 18 by a switching flapper 17 and is discharged as a one-surface image-formed product onto a discharge tray 19.

In the case of a double-surface (side) image forming mode such that the toner images are formed on double surfaces (sides) of the sheet P, the sheet P on which the toner image has been formed at one surface thereof is fed toward the tray 19 by the discharging roller pair 18, and when a trailing end portion of the sheet P comes out of the fixing device 40 and reaches a reversing point 20, the discharging roller pair 18 is reversely rotated. As a result, the sheet P is fed in a switch-back manner and is introduced into a path 21 for double-surface image formation.

Then, the sheet P that passes through the path 21 is fed again to the post-sheet feeding path 12, by a feeding roller pair 22, in a state in which the sheet P is turned upside down, at a side in front of the registration roller pair 13. Thereafter, the sheet P is subjected to a process similar to that in the case of the one-surface image forming mode, so that the sheet P is discharged as a double-surface image-formed product onto the discharging tray 19.

Incidentally, a portion constituted by a switch-back operation with the flapper 17 and the discharging roller pair 18 is an example of a reversing means. In this embodiment, the reversal is made by the discharging roller pair 18, but in order to enhance productivity of the printing (image formation), the reversal may also be carried out in a place other than the place of the discharging roller pair 18 by providing a reversing portion, a plurality of discharging portions, or the like.

At an outer (contour) portion of the engine portion 600, a manual sheet feeding portion (manual tray) 23 is provided as a sheet (paper) feeding portion other than the sheet feeding cassette 9. This manual sheet feeding portion 23 is provided for the purpose in consideration of user operativity such that the user can easily set a certain sheet, e.g., in the case where the user intends to form the image on the certain sheet P different in kind from the sheet P set in the sheet feeding cassette 9.

In image formation by feeding the sheet (paper) from the manual sheet feeding portion 23, a sheet feeding roller 24 is driven at predetermined control timing, so that the sheets P set on the manual sheet feeding portion 23 are fed one by one. The fed sheet P passes through a feeding path 25 and is introduced into the post-sheet feeding path 12 by the feeding roller pair 22 in the side in front of the registration roller pair 13. Thereafter, the image formation is executed similarly as in the case of the sheet feeding from the sheet feeding cassette 9. The manual sheet feeding portion 23 is provided with a manual sheet feeding sensor (detecting portion) 230 for detecting the presence/absence state of the sheet P, so that the presence or absence of the sheet P at the manual sheet feeding portion 23 is detectable.

Incidentally, the manual sheet feeding sensor 230 may only be required to have a constitution capable of detecting whether or not the sheet P is present (exists) on the manual sheet feeding portion 23. Accordingly, the manual sheet feeding portion 230 may also employ a constitution for detecting that the sheet P is present on the manual sheet feeding portion (i.e., "presence") or may also employ a constitution for detecting that the sheet P is not present on the manual sheet feeding portion (i.e., "absence (non-presence)". In the former case, for example, the manual sheet feeding sensor 230 reacts and sends a detection signal when the sheet P is present on the manual sheet feeding portion 23 and does not react and does not send the detection signal in the case where there is no detection signal when the sheet P is not present on the manual sheet feeding portion 23. In the latter case, for example, the manual sheet feeding sensor 230 reacts and sends a detection signal when the sheet P is not present on the manual sheet feeding portion 23 and does not react and does not send the detection signal in the case where there is no detection signal when the sheet P is present on the manual sheet feeding portion 23. In this embodiment, as an example, as in the former case, the manual sheet feeding sensor 230 will be described as the sensor for detecting that the sheet P is present on the manual sheet feeding portion 23 (i.e., the "presence").

As means for detecting the state of the sheet P during feeding of the sheet P through the feeding path, sheet detecting sensors are provided along the feeding paths. In the copying machine A shown in FIG. 1, sheet detection in a side downstream of the registration roller pair 13 is performed by a registration sensor 200. Further, sheet detection in a side downstream of the fixing device 40 is performed by an inner sheet discharge sensor 201. Further, sheet detection in a side downstream of the sheet discharging roller pair 18 is performed by a sheet discharge sensor 202. The CPU 810 of the engine controller 802 selectively goes to a subsequent step in response to each of detection signals of these sensors 200, 201 and 202.

For example, the CPU 810 discriminates that the sheet P jams in any place (jam occurrence) in the case where an on-time of either of the sensors is longer than a predetermined time in a sequence during feeding of the sheet P through the feeding path or in the case where a time when the sheet P reaches either of the sensors is slower than the predetermined time in the sequence. Then, the CPU 810 stops driving portions (not shown) for the respective rollers on the basis of the detection signals so that a sheet jamming state does not progress.

Figure 4:
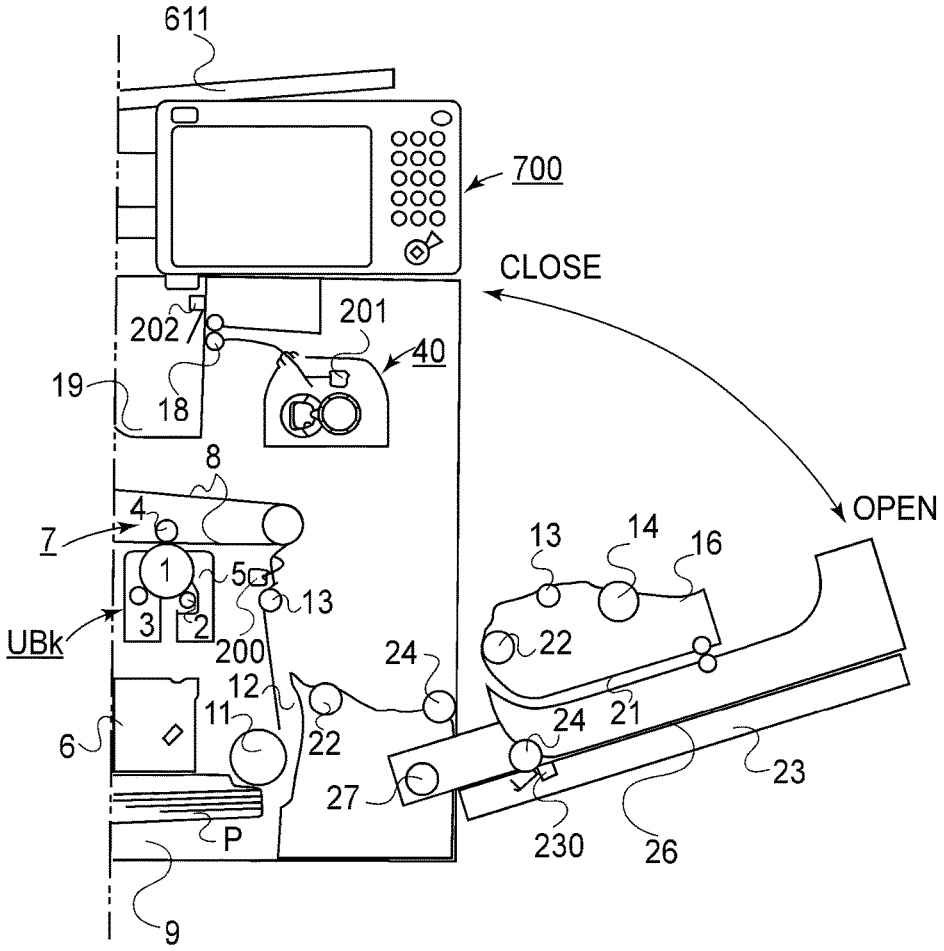
FIG. 4 is an illustration of jam clearance.

For the purpose of removing the jammed sheet P from an inside of the image forming apparatus after the sheet P jams inside the image forming apparatus and the respective sensors detect the jam, the engine portion (apparatus main assembly) 600 is provided with a door 26 rotatable about a hinge 27 in a rightward direction (opening direction) as shown in FIG. 4. The door 26 is provided with the pre-fixing feeding path 16, the secondary transfer roller 14 and one (shown in the right-hand side in the figure) of the registration roller pair 13. Accordingly, by opening the door 26, the feeding paths other than the fixing device 40 are opened (exposed) between the post-sheet feeding path 12 and the discharging roller pair 18. As a result, removal of the jammed sheet in the feeding path can be easily carried out.

Incidentally, the manual sheet feeding portion 23 can be placed in a retracted state during non-use by being closed (raised upright) to an outer surface of the door 26 as indicated by a chain double-dashed line in FIG. 1. During use, the manual sheet feeding portion 23 can be placed in a developed state in which the manual sheet feeding portion 23 is rotated outwardly from the outer surface of the door 26 to a predetermined inclination angle attitude as indicated by a solid line in FIG. 1.

[Fixing Device]

Figure 5:
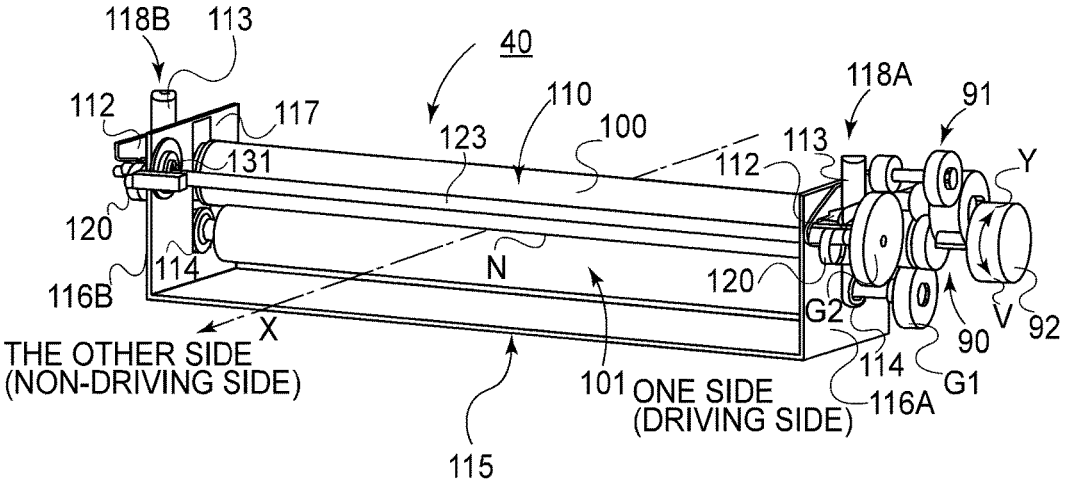
FIG. 5 is a schematic perspective view of an outer appearance of a fixing device.
Figure 6:
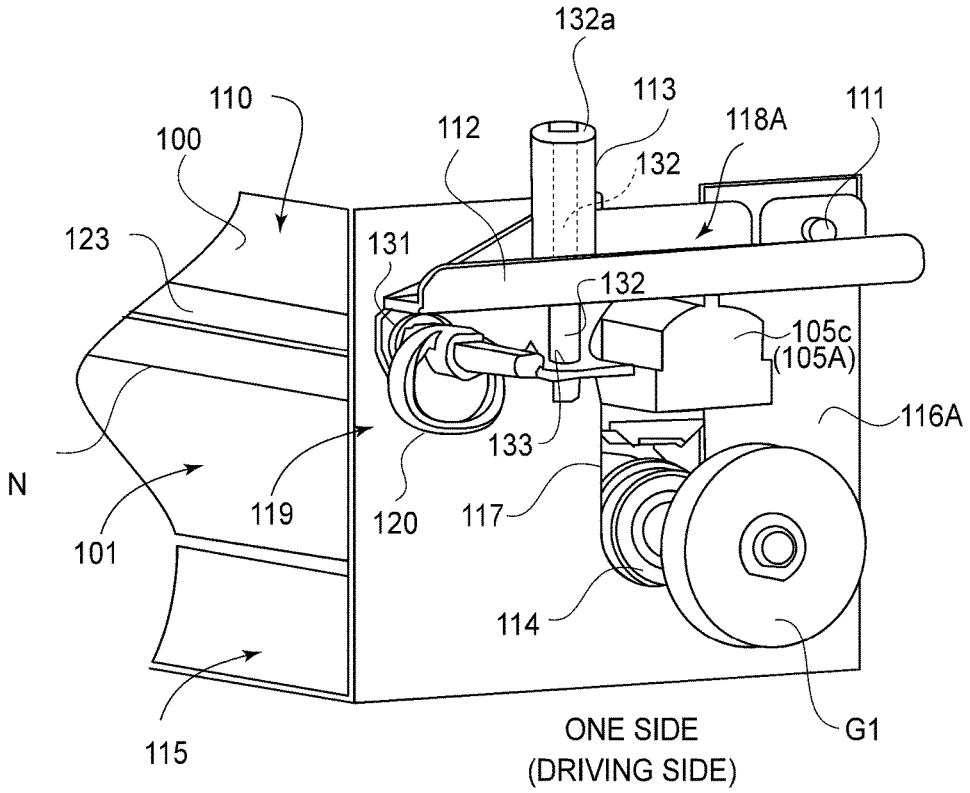
FIG. 6 is a schematic perspective view of a principal part of the fixing device at one end side (driving side) with respect to a longitudinal direction.
Figure 7:
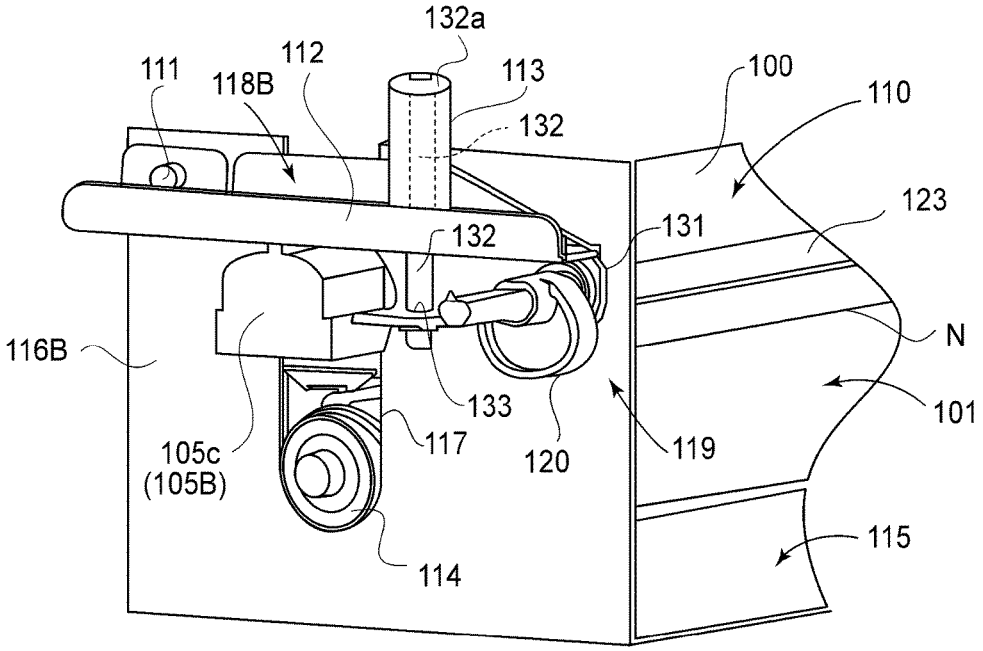
FIG. 7 is a schematic perspective view of a principal part of the fixing device at the other end side (non-driving state) with respect to the longitudinal direction.
Figure 8:
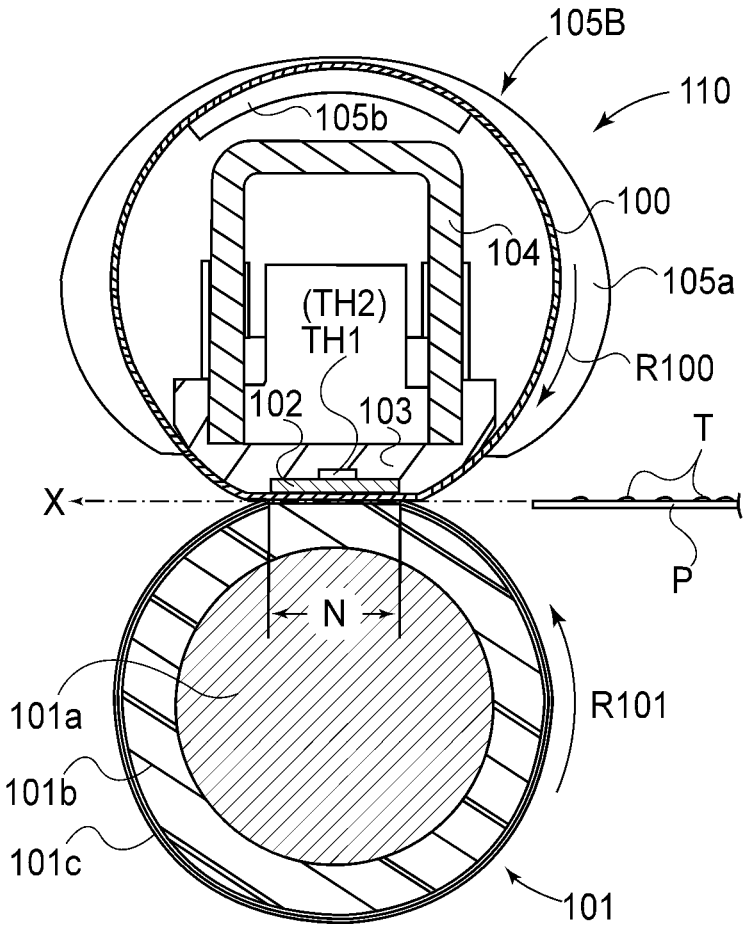
FIG. 8 is an enlarged schematic cross-sectional view of a principal part of the fixing device.

FIG. 5 is a schematic perspective view of an outer appearance of the fixing device 40. FIG. 6 is a schematic perspective view of a principal part of the fixing device 40 at one end side (driving side) with respect to a longitudinal direction of the fixing device 40, and FIG. 7 is a schematic perspective view of a principal part of the fixing device 40 at the other end side (non-driving side) with respect to the longitudinal direction. FIG. 8 is a schematic sectional view of a principal part of the fixing device 40.

Figure 9:
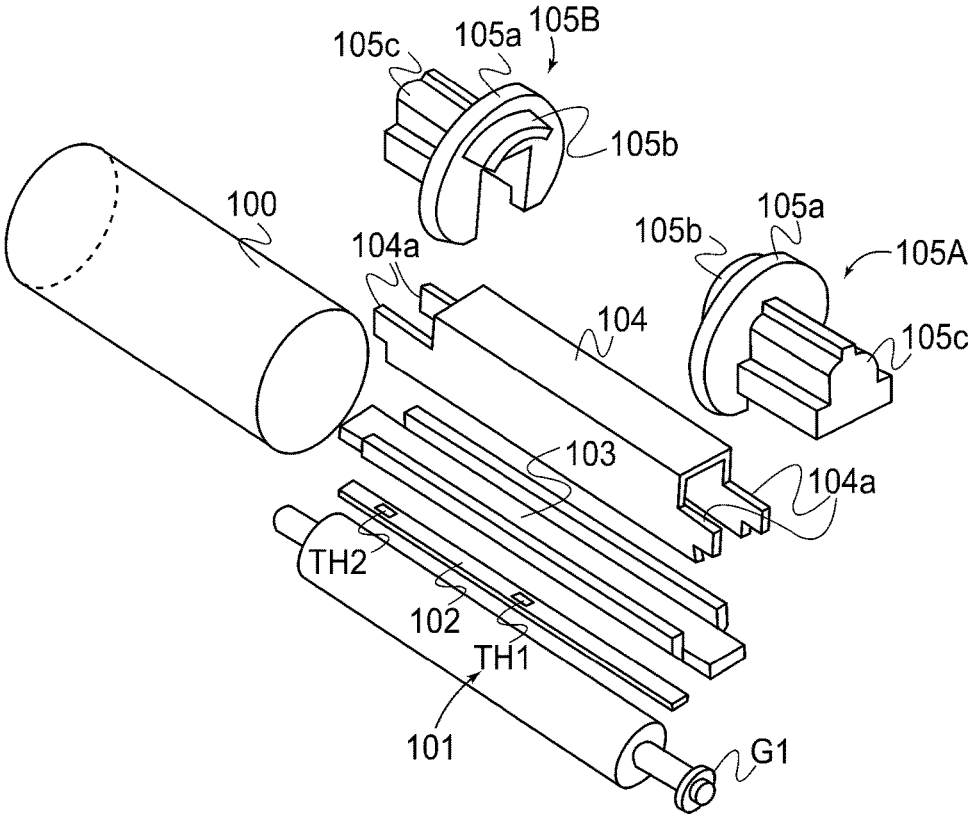
FIG. 9 is an exploded schematic perspective view of a fixing belt unit.

The fixing device 40 is an image heating apparatus (device) of a belt heating type and is roughly constituted by a fixing belt unit 110 including a fixing belt (first rotatable member) 100, an elastic pressing roller (second rotatable member) 101, and a fixing frame (device casing) 115 accommodating these members. In the following, the fixing belt unit 110 is referred to as the unit 110. A nip (fixing nip) N is formed by the fixing belt 100 and the pressing roller 101 which are a pair of rotatable members (FIG. 8). The nip N is a portion where the sheet P on which an unfixed toner image T is carried is nipped and fed and where the toner image is fixed on the sheet P by heat and pressure. As shown in FIG. 8, the unit 110 is an assembly of a cylindrical fixing belt 100, a heater holder (pressing member) 103, a heater (heating member) 102, a pressing stay (belt frame) 104, flange members (belt guides) 105A and 105B, and the like. FIG. 9 is an exploded schematic perspective view of this unit 110, in which also the pressing roller 101 is illustrated.

(1) Fixing Belt

The fixing belt 100 (hereinafter referred to as the belt 100) is a heat-conductive member having flexibility and heat resistance and formed in a thin hollow endless belt shape. The belt 100 is formed in a total thickness of 150 μm or less with a heat-resistant resin material such as a polyimide film or a PEEK film in order to improve a quick start property by reducing thermal capacity. In order to enhance thermal conductivity, an elastic layer of a rubber material high in thermal conductivity is formed on a resin layer to which an electroconductive material is added, and on a surface of the elastic layer, a parting layer of a fluorine-containing resin material is formed, so that an endless belt of 25 mm in inner diameter is prepared.

In this embodiment, a 30 μm-thick polyimide film was used as a base layer, a 70 μm-thick silicone rubber layer of 1.0 W/m.K in thermal conductivity was used as the elastic layer, and a 30 μm-thick PFA tube was used as the parting layer. The PFA tube (layer) may preferably be a sheet or a coat layer which is high in parting property, and for example, a fluorine-containing resin layer can be used as the PFA layer. Further, the belt 100 may also be prepared by forming the base layer with a sheet-shaped member high in heat resistance and represented by polyester, polyethylene terephthalate, polyimideamide or the like and then by laminating an electroconductive layer on the base layer and further by laminating a surface parting layer on the electroconductive layer.

(2) Heater Holder

The heater holder 103 is a nip forming member on which the heater 102 is fixed and supported. The heater holder 103 has a trough shape having a substantially semi-circular cross-section and is a heat-insulating member, of a heat-resistant resin material, extending along a longitudinal direction (widthwise direction) of the belt 100. From a viewpoint of energy saving, a material small in degree of heat conduction toward the pressing stay 104 may desirably be used, and for example, heat-resistant glass or a heat-resistant resin material such as polycarbonate or a liquid crystal polymer is used.

(3) Heater

The heater 102 is an elongated plate-shape heat generating member which abruptly increases in temperature by energization and which has low thermal capacity, and is a ceramic heater in this embodiment. In the heater 102, the heat generating member is formed by printing Ag/Pd paste in a thick film on an AlN substrate which has an elongated thin plate shape and which is good in heat conduction and then by baking the paste. Then, an about 50-60 μm thick glass coating layer is formed, as a slidable insulating member, integrally on the heat generating member, so that the ceramic heater is prepared. In this embodiment, a heat generating resistance layer is formed on a 600 μm-thick AlN substrate. The heater 102 is engaged and held in a groove portion formed along an outer surface of the heater holder 103 with respect to a longitudinal direction of the heater holder 103.

On the other hand, on the AlN substrate, in a side opposite from a side where the heat generating member is provided, a chip-shaped thermistor TH1 is provided. The thermistor TH1 is adhesively fixed on an electrode pattern, formed in advance by printing in a thick film, in a side opposite from a region in which the heat generating member exists, and monitors a temperature of the AlN substrate. Further, also at a position in the neighborhood of an end portion of the heat generating member, a thermistor TH2 is provided.

Each of the thermistors TH1 and TH2 is fixed to the substrate with a predetermined pressure by an unshown pressing means such as a spring in order to detect such a temperature that exceeds a heat-resistant temperature of an adhesive.

(4) Pressing Stay

The pressing stay 104 is a rigid member which is long along the widthwise direction of the belt 100 and which receives reaction force from the pressing roller 101, and may desirably be a material which is not readily flexed (bent) even under application of a high pressure. In this embodiment, a molded material of SUS304 having a U-shape in cross section is used. The pressing stay 104 is provided inside the heater holder 103 and supports the heater holder 103.

(5) Flange Member

The belt 100 is loosely fitted around an assembly of the heater holder 103, the heater 102 and the pressing stay 104 which are described above. End portions 104*a* of the pressing stay 104 project outwardly from openings of associated end portions of the belt 100, respectively. With the end portions 104*a* of the pressing stay 104, flange members 105A and 105B are engaged, respectively. The belt 100 is detected between opposing flange portions 105*a* and 105*a* of the engaged flange members 105A and 105B. The flange members 105A and 105B are regulating members for regulating (preventing) movement of the belt 100 of the unit 110 in the longitudinal direction and a shape of the belt 100 of the unit 110 with respect to a circumferential direction.

Each of the flange members 105A and 105B is a molded product of a heat-resistant resin material such as PPS, a liquid crystal polymer or a phenolic resin, and includes the flange portion (flange seat portion) 105*a*, a platform portion 105*b* and a portion-to-be-urged (pressed) 105*c*.

The flange portion 105*a* is a portion for preventing movement of the belt in a thrust direction by receiving an edge surface of the end portion of the belt 100 and has an outer shape (configuration) larger than an outer shape of the belt 100. The platform portion 105*b* is provided in an arcuate shape in an inner surface side of the flange portion 105*a* and maintains a cylindrical shape of the belt 100 by holding (supporting) an inner surface of the belt end portion. The portion-to-be-urged 105*c* is provided in an outer surface side of the flange portion 105*a* and receives a pressing (urging) force by an associated one of pressing mechanisms 118A and 118B described later.

(6) Pressing Roller

The pressing roller 101 includes a cylindrical core metal 101*a* formed of iron, aluminum or the like, an elastic layer 101*b* formed, in an outer peripheral surface side of the core metal 101*a*, of a soft rubber material such as a sponge or a silicone rubber, and a PAF layer as a parting layer 101*c* which is a surface layer.

In this embodiment, the surface of the core metal 101*a* of iron, aluminum or the like is subjected to a surface roughening treatment and thereafter is subjected to washing. Then, the core metal 101*a* is inserted into a cylindrical mold, and a liquid silicone rubber is poured into the mold and then is heat-cured, so that the elastic layer 101*b* is formed. At this time, in order to form a resin tube layer such as a PFA tube as a parting layer 101*c* on a surface of the elastic layer 101*b*, a tube onto which a primer is applied in advance at an inner surface thereof is inserted into the mold. As a result, bonding between the tube 101*c* and the rubber layer 101*b* is carried out simultaneously with the heat-curing of the rubber as the elastic layer 101*b*. The thus-molded pressing roller 101 is subjected to a demolding process, followed by secondary vulcanization.

In this embodiment, as regards the pressing roller 101, the core metal 101*a* was 15 mm in diameter, the elastic layer 101*b* was a silicone rubber of 5 mm in thickness and 64° in Asker-C hardness, the PFA tube as the parting layer 101*c* was 50 μm in thickness, and the resultant pressing roller 101 was about 25 mm in outer diameter.

The pressing roller 101 is rotatably supported, between side plates 116A and 116B at one end side and the other end side of the fixing frame 115, at one end side and the other end side of the core metal 101*a* via bearings 114.

The unit 110 is disposed in parallel to the pressing roller 101 so as to oppose the pressing roller 101 at the heater 102 side between the side plates 116A and 116B. The flange members 105A and 105B of the unit 110 are engaged in guiding holes 117 formed symmetrically in the side plates 116A and 116B with respect to the belt 100 so that the portions-to-be-urged are slidable (movable) in a direction of the pressing roller 101 along the guiding holes 117.

Further, the flange members 105A and 105B receive predetermined pressure at the portions-to-be-urged 105*c* in a direction toward the pressing roller 101 by the pressing mechanisms 118A and 118B described later. In this embodiment, the pressure is 125N at each of one end side and the other end side and is 250N as a total pressure.

By the pressure, an entirety of the flange members 105A and 105B of the unit 110, the pressing stay 104 and the heater holder 103 is pressed (urged) in the direction of the pressing roller 101. For that reason, the heater holder 103 and the heater 102 are urged toward the pressing roller 101 through the belt 100 with the predetermined pressure against elasticity of the elastic layer 101*b*, so that the nip N having a predetermined width with respect to a sheet feeding direction X is formed between the belt 100 and the pressing roller 101.

(7) Fixing Operation

At one end side of the core metal 101*a* of the pressing roller 101, a driving gear G1 is provided concentrically integral with the core metal 101*a*. To this gear G1, a pressing force of a fixing motor (driving source) 92 controlled by the CPU 810 is transmitted through a drive transmission mechanism portion of a fixing (device) driving portion 90. As a result, the pressing roller 101 is rotationally driven as a rotatable driving member at a predetermined speed in the counterclockwise direction of an arrow R101 in FIG. 8. The pressing roller 101 is rotationally driven, so that in the nip N, a rotational torque acts on the belt 100 by a frictional force of the belt 100 with the pressing roller 101.

As a result, the belt 100 is rotated by the pressing roller 101 in the clockwise direction of an arrow R100 around the heater holder 103 and the pressing stay 104 while intimately sliding at an inner surface thereof with the heater 102 and a part of the heater holder 103 in the nip N. A rotational peripheral speed of the belt 100 substantially corresponds to a rotational peripheral speed of the pressing roller 101. For the purpose of reducing the frictional force, a lubricant (not shown) is applied in advance onto a sliding surface of the belt 100 with the heater 102 and the heater holder 103. As the lubricant, in this embodiment, oil is applied. As the oil, a silicone oil or the like capable of being used in a high-temperature environment may preferably be employed.

The CPU 810 starts energization from an energizing portion (not shown) to the heater 102. Although an energization path from the energizing portion to the heater 102 is omitted from illustration in the figures, energization is carried out through wiring and a connector which electrically connect the energizing portion with the heater 102. By this energization, the heater 102 abruptly increases in temperature. The thermistor TH1 outputs, to the CPU 810, a signal depending on the temperature of the heater 102. On the basis of the heater temperature detected by the thermistor TH1, the CPU 810 controls electric power supplied from the energizing portion to the heater 102 so that the heater temperature increases up to a predetermined target setting temperature and is controlled at the setting temperature.

In the above-described state of the fixing device 40, the sheet P, on which the unfixed toner image T is provided, is introduced from the image forming portion 10 into the fixing device 40, and then is nipped and fed through the nip N. In a process in which the sheet P is nipped and fed through the nip N, heat of the heater 102 is supplied to the sheet P through the belt 100. The unfixed toner image T is melted by the heat of the heater 102 and is fixed on the sheet P by the pressure applied to the nip N.

(8) Pressing Mechanism

Outside the side plates 116A and 116B at one end side and the other end side of the fixing frame 115, the pressing mechanisms 118A and 118B at one end side and the other end side are provided, respectively. These pressing mechanisms 118A and 118B have the same symmetrical structure, and therefore, the pressing mechanism 118A at one end side will be described as a representative example.

The pressing mechanism 118A includes a pressing lever 112 and a pressing spring 113. The pressing lever 112 is mounted to the side plate 116A at a base portion side so as to be swingable about an axis portion 111. The pressing lever 112 extends from the axis portion 111 toward a side opposite from the axis portion 111 side through a position of the portion-to-be-urged 105*c* of the flange member 105A. The press spring 113 is an elastic member for rotationally urging the pressing lever 112 about the axis portion 111 in a state in which the pressing lever 112 is contacted to and pressed against the portion-to-be-urged 105*c* of the flange member 105A.

In this embodiment, the pressing lever 112 is provided at a portion thereof with a through-hole (not shown) at a side opposite from the axis portion 111 side with respect to the portion-to-be-urged 105*c* as a center, and an elongated pressure adjusting screw 132 is inserted into the through-hole, so that a free end portion of the screw 132 is threadably engaged with a screw hole (bore) 133 in the side plate 116A side. Further, the pressing spring 113 having a coil shape is externally fitted and compressedly provided on a screw portion between a head portion (bearing surface) 132*a* of the screw 132 and the pressing lever 112. Accordingly, in a free state, the pressing lever 112 contacts the portion-to-be-urged 105*c* of the flange member 105A by a compression reaction force of the pressing spring 113 and applies the pressure to the flange member 105A.

By fastening the screw 132, the head portion 132*a* of the screw 132 decreases a spring length of the pressing spring 113, so that a spring load applied to the pressing lever 112 can be increased. The pressing lever 112 is rotatably supported by the side plate 116A, and therefore, rotation moment around the axis portion 111 is generated by the compression reaction force of the pressing spring 113, so that the flange member 105A is pushed in the direction of the pressing roller 101 with a predetermined pressure.

The pressing mechanism 118A at one end side was described above, but also the pressing mechanism 118B at the other end side is similar in constitution to the pressing mechanism 118A at one end side.

(9) Pressure-Releasing Mechanism

Release (elimination) of the pressure applied by the pressing mechanisms 118A and 118B at one end side and the other end side is carried out by a pressure-releasing mechanism 119. In this embodiment, the pressure-releasing mechanism 119 includes cams 120, at one end side and the other end side, for swinging the pressing levers 112 of the pressing mechanisms 118A and 118B at one end side and the other end side, respectively.

These two cams 120 have the same shape such that each cam 120 has a predetermined amount of eccentricity, and are fixed on a cam shaft 123, with the same phase at one end side and the other end side, provided and rotatably supported through bearings 131 between the side plates 116A and 116B, and are rotated integrally with the same shaft 123. The cams 120 at one end side and the other end side are positioned correspondingly to free end sides of the pressing levers 112 of the pressing mechanisms 118A and 118B at one end side and the other end side, respectively.

At one end side of the cam shaft 123, a driving gear G2 is fixedly provided integrally with the cam shaft 123. To this gear G2, a driving force of the fixing motor 92 controlled by the CPU 810 is transmitted through a drive transmission mechanism of a cam driving portion 91.

Figure 10:
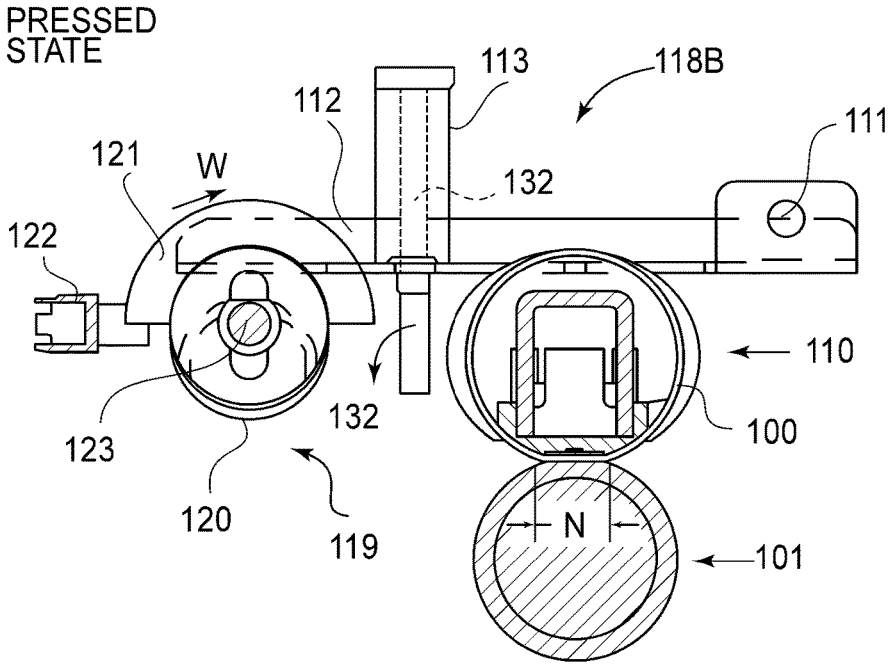
FIG. 10 is a schematic view of the fixing device during a pressed state.

FIG. 10 shows a state in which the belt 100 and the pressing roller 101 are in a press-contact state and thus the nip N with a predetermined width is formed therebetween. In this state, the cams 120 at one end side and the other end side of the pressure-releasing mechanism 119 oppose the pressing levers 112 of the pressing mechanisms 118A and 118B at one end side and the other end side, respectively, at minimum protruded portions thereof, and thus are in a rotation angle attitude in non-contact with the pressing levers 112.

For that reason, the pressing levers 112 are in a free state, so that the flange members 105A and 105B at one end side and the other end side are pressed by the pressing springs 113 and the pressing levers 112 of the pressing mechanisms 118A and 118B at one end side and the other end side, respectively. As a result, the belt 100 and the pressing roller 101 are maintained in the state such that the belt 100 and the pressing roller 101 are in the press-contact state and the nip N with the predetermined width is formed therebetween.

Figure 11:
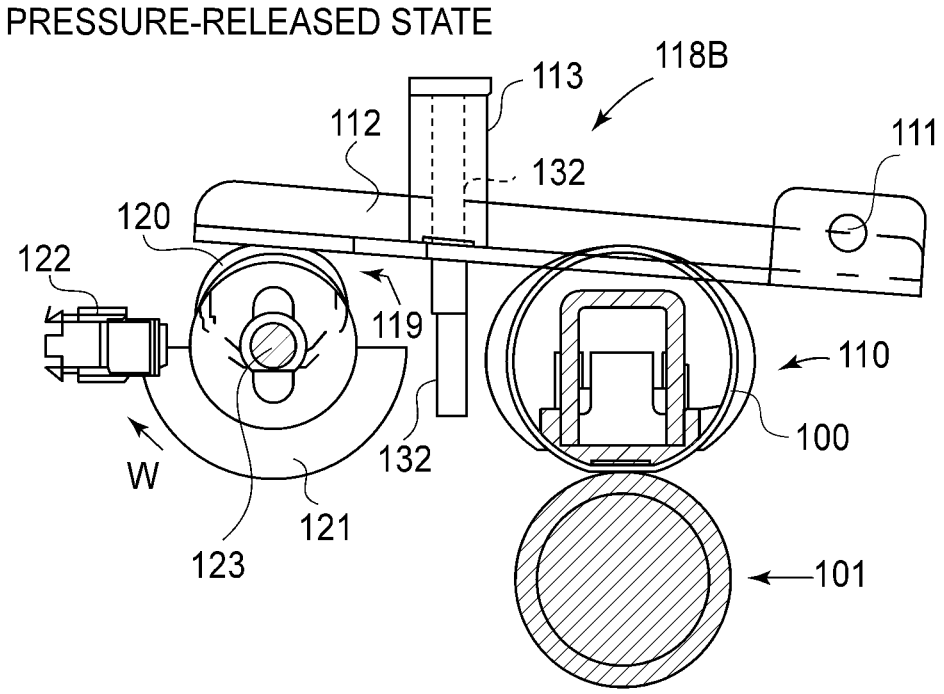
FIG. 11 is a schematic view of the fixing device during a pressure-released state.

FIG. 11 shows a pressure-released state. In the pressed state (press-contact state) of FIG. 10, the driving force of the fixing motor 92 is transmitted to the gear G2 through the drive transmission mechanism of the cam driving portion 91 and thus the cam shaft 123 is rotated, so that the cams 120 at one end side and the other end side are rotated with the same phase. Then, the cams 120 are in the rotation angle attitude such that maximum protruded portions thereof oppose the pressing levers 112 at one end side and the other end side, respectively.

Then, the pressing levers 112 at one end side and the other end side are pushed up against spring forces of the pressing springs 113 by the cam 120 in a direction in which the pressing levers 112 are spaced from the portions-to-be-urged 105*c* of the flange members 105A and 105B at one end side and the other end side. As a result, the pressure between the fixing belt 100 and the pressing roller 101 is released (eliminated).

(10) Pressure-Releasing Control and Pressing Control

A pressure-releasing operation is performed by enhancing a removing operation property of a jammed sheet in the case where the sheet P jams when the sheet P is fed through the nip N. Further, the pressure between the belt 100 and the pressing roller 101 is released so that a press-contact trace is not left on the belt 100 and the pressing roller 101 in the press-contact state in which the fixing device is not driven for a predetermined time or more.

As a means for detecting a press-contact position and pressure-releasing roller during a rotation operation of the cam 120, a sensor flag 121 is provided coaxially with the cam shaft 123 which is a supporting shaft of the cam 120, and rotates in synchronization with the rotation of the cam 120, so that a rotational direction position thereof is detected by a contact and spacing sensor 122. The contact and spacing sensor 122 permits transmission of infrared (IR) rays therethrough, and the sensor flag 121 blocks or transmits the IR rays, so that a signal is sent.

In an operation from the press-contact state (pressed state) of FIG. 10 to the pressure-released state of FIG. 11, in accordance with a pressure-releasing instruction signal from the engine controller 802, the CPU(ENG) 810 stops the fixing motor 92 of the fixing driving portion 90. After the stop of the fixing motor 92, the fixing motor 92 is rotationally driven in a motor reversing direction V (FIG. 5) which is the CCW (counterclockwise direction), so that the cam 120 is started to be rotated in a W direction by drive transmission of the cam driving portion 91 through a driving path. With the rotation, the sensor flag 121 provided coaxially with the cam shaft 123 rotates simultaneously.

The contact and spacing sensor 122 is in a transmission state before the rotation operation of the sensor flag 121 and maintains the transmission state during the rotation operation, and when the sensor flag 121 blocks an IR ray irradiation region of the contact and spacing sensor 122 and thus the contact and spacing sensor 122 is in a light-blocked state, the cam 120 is in a pressure-releasing completion position. By a change in output signal of the contact and spacing sensor 122 at this time, the pressure-released state is detected and the fixing motor 92 is stopped, so that the pressure-releasing is completed.

The pressure-releasing instruction signal from the engine controller 802 is outputted in the case where the respective sheet detecting sensors detect the (sheet) jam, the case where the door 80 is open, the case where the mode of the copying machine A goes to the low electric power mode M4, and the like case.

Further, in a press-contact operation from the pressure-released state of FIG. 11 to the press-contact state of FIG. 10, in accordance with a press-contact instruction signal from the engine controller 802, the press-contact operation between the belt 100 and the pressing roller 101 is started for restoring the state of the fixing device 40 to the image forming state.

First, the CPU(ENG) 810 rotationally drives the fixing motor 92 in the motor reversing direction V (FIG. 5) which is the CCW (counterclockwise direction), so that the cam 120 is started to be rotated in a W direction by drive transmission of the cam driving portion 91 through a driving path. With the rotation, the sensor flag 121 provided coaxially with the cam shaft 123 rotates simultaneously.

The contact and spacing sensor 122 is in the light-blocked state during the pressure-releasing and maintains the light-blocked state during the rotation operation of the sensor flag 121, and when the sensor flag 121 rotates to the pressure-releasing completion position, the sensor flag 12 passes through the IR ray irradiation region of the contact and spacing sensor 122 and thus the contact and spacing sensor 122 is in the transmission state. By a change in output signal of the contact and spacing sensor 122 at this time, the press-contact state in the nip N is detected and the fixing motor 92 is stopped, so that the press-contact is completed.

The press-contact instruction signal from the engine controller 802 is outputted when the copying machine A is in the image forming state while the mode thereof goes to the image forming mode M1. The image forming state refers to a state in which the copy button 720 is pressed or an image forming signal is inputted from an external device such as a PC (personal computer), or the like state.

Thus, the fixing motor 92, the cam driving portion 91, the cams 120 and the like move the pressing mechanisms between a position providing the press-contact state and a position providing the pressure-released state, whereby the fixing device 40 can be placed in the press-contact state (pressed state) and in the pressure-released state. That is, the fixing motor 92, the cam driving portion 91, the cams 120 and the like function as a moving mechanism for moving the pressing mechanisms.

(11) Mode Shift (Transition)

Figure 12:
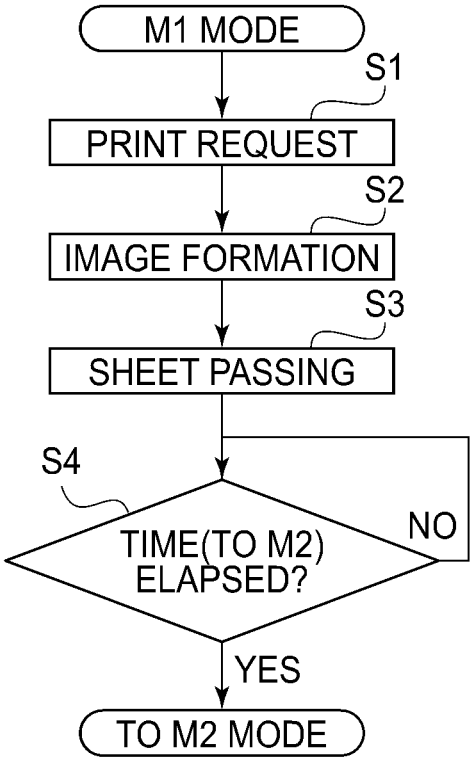
FIG. 12 is a flowchart of an operation in an image forming mode.
Figure 13:
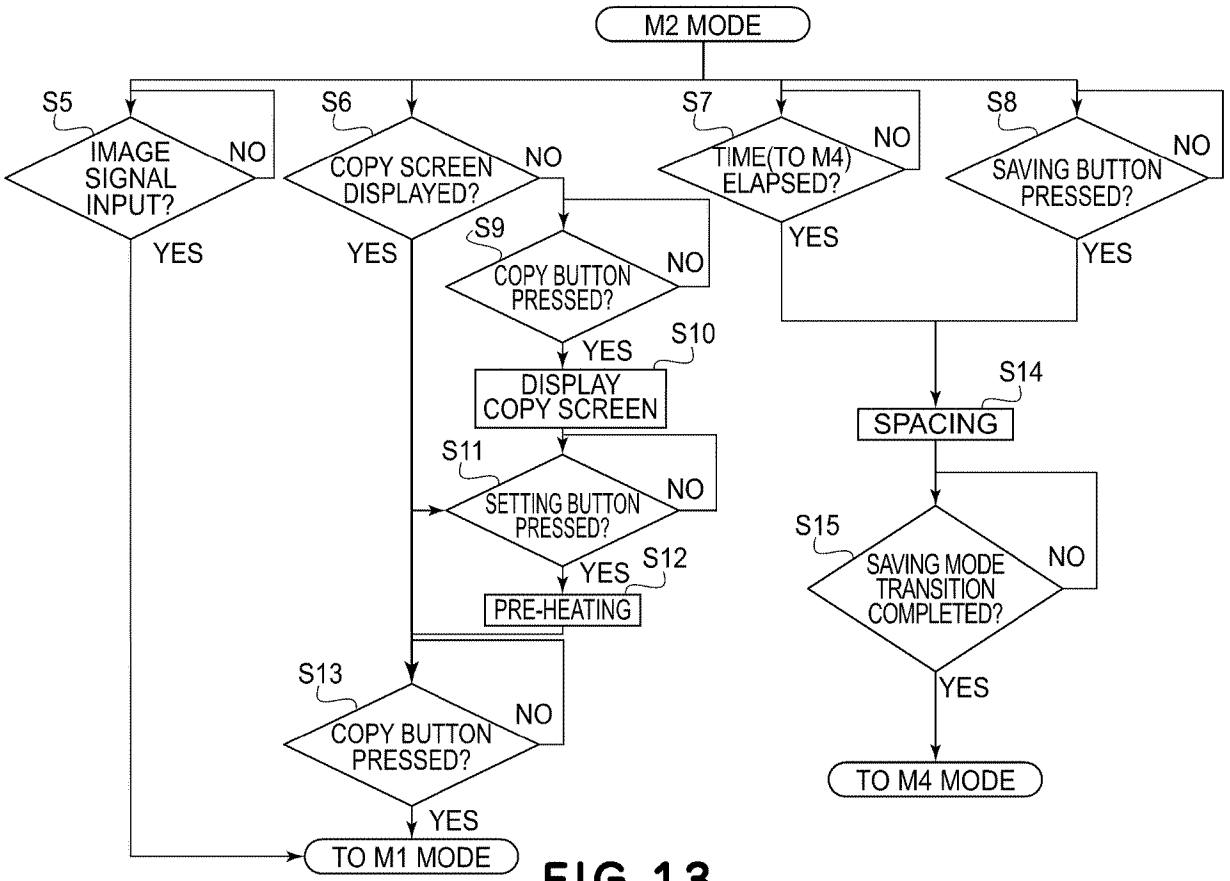
FIG. 13 is a flowchart of an operation in a stand-by mode.
Figure 14:
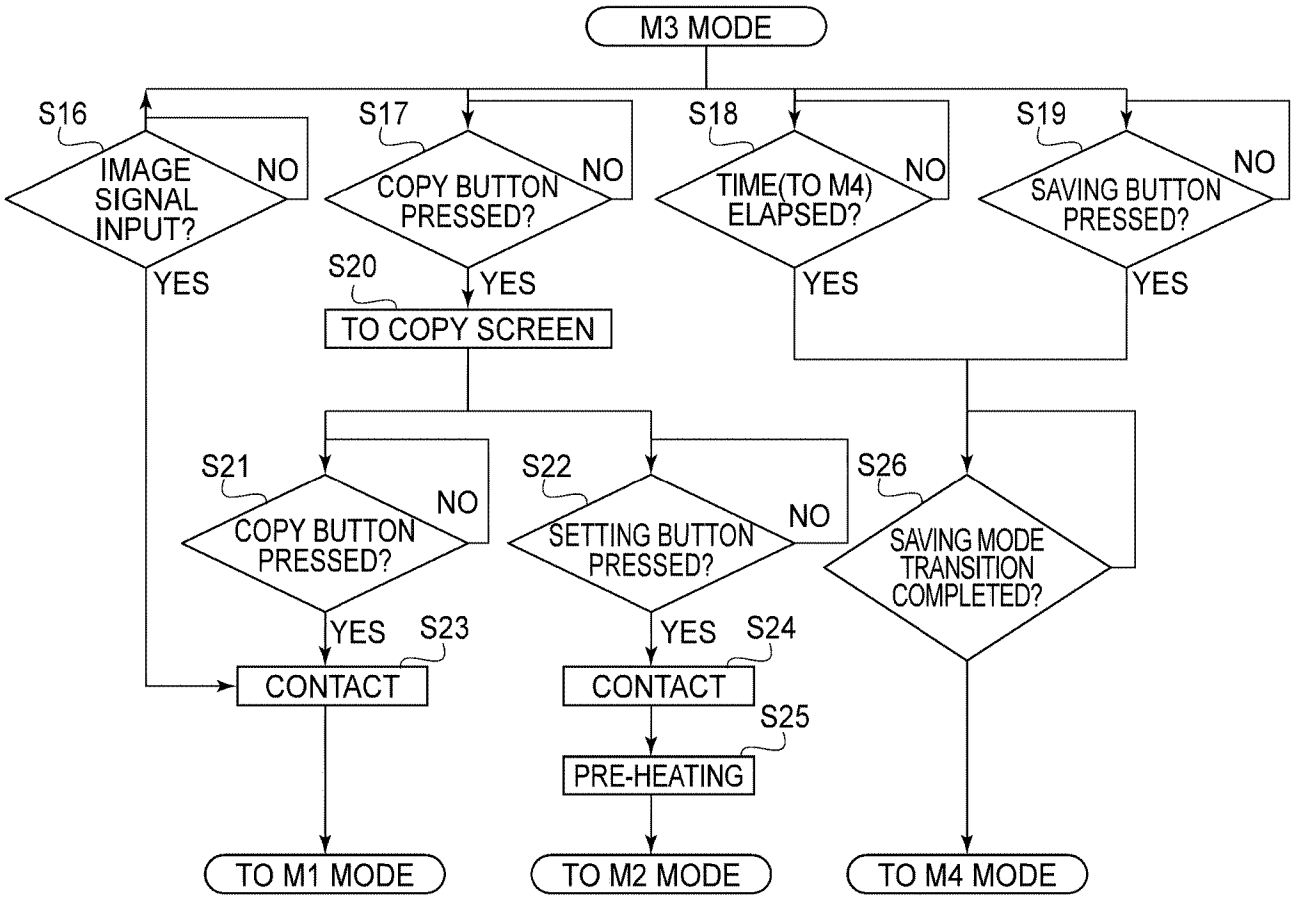
FIG. 14 is a flowchart of an operation in a post-restoration mode from a low electric power mode.
Figure 15:
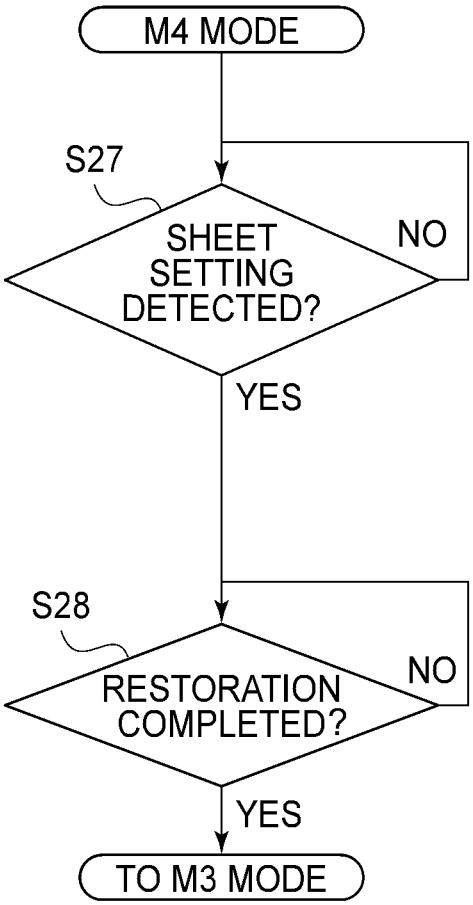
FIG. 15 is a flange of an operation in the low electric power mode.

Next, operation for shifting the mode of the copying machine A to the image forming mode M1, the stand-by mode M2 and the low electric power mode M4 and mechanisms relating to the operations will be described with reference to FIGS. 2 and 12 to 15. FIG. 12 is a flowchart of the image forming mode. FIG. 13 is a flowchart of the stand-by mode. FIG. 14 is flowchart of the post-restoration mode from the low electric power mode. FIG. 15 is a flowchart of the low electric power mode.

When the copying machine A ends the image formation and a shift time, stored in the RAM(ENG) 812, from a state of the image forming mode M1, in which the copying machine A is in the image forming operation states, to a state of the stand-by mode M2 has elapsed, the mode of the copying machine A shifts (goes) to the stand-by mode M2 (from S1 to S4 in FIG. 12). In this embodiment, a set value of the shift time to the state of the stand-by mode M2 was 15 seconds (S4).

The state of the stand-by mode M2 is a first stage of a stand-by state of the copying machine A, and each of the image forming units is in an image formation preparatory state in which the copying machine A is capable of image formation immediately after an image forming signal is inputted to the engine controller 802 (from S5 to S13 in FIG. 13). At this time, in the fixing device 40, the belt 100 and the pressing roller 101 are in the press-contact state, and the heater 102 and the fixing motor 92 are in a non-operation state (non-energization state).

When a shift time, stored in the RAM(ENG) 812, from the state of the stand-by mode M2 to a state of the low electric power mode M4 has elapsed, the mode of the copying machine A shifts to the low electric power mode M4 (S7, S14, S15). In this embodiment, a set value of the shift time to the state of the low electric power mode M4 was 1 minute (S7). Further, in response to pressing-down of the low electric power mode button 712, the mode of the copying machine A shifts from the stand-by mode M2 to the low electric power mode M4 (S8, S14, S15).

The state of the low electric power mode M4 is a second stage of the stand-by state of the copying machine A and is a state such that stand-by electric power of the copying machine A is lowered to the extent possible and thus is an energy-saving state. For that reason, the engine portion 600, the engine controller 802 including the CPU(ENG) 810, and the image reading portion 601 are caused to be at rest, so that the copying machine A is in an image formation-disabled state (S15).

The engine portion 600 and the operating portion 700 have a restoring function from the low electric power mode M4, and therefore functional portions other than a restoring functional portion are caused to be at rest. The CPU(CNT) 820 of the main controller 801 is in an operation state which is an all-night operation state in which the copying machine A is operable for performing a restoring operation from the low electric power mode M4. At this time, in the fixing device 40, the belt 100 and the pressing roller 101 are in the pressure-released state, and the heater 102 and the fixing motor 92 are in the non-operation state (non-energization state).

Next, the restoring operation from the low electric power mode M4 of the copying machine A and a mechanism relating to the restoring operation will be described. In the state of the low electric power mode M4, functional portions other than a restoring condition functional portion from the low electric power mode M4 are in a rest state. In order to restore the mode of the copying machine A from the low electric power mode M4, the restoring operation is performed by the restoring condition functional portion and a restoring condition signal is outputted from the restoring condition functional portion, so that the mode of the copying machine A shifts from the low electric power mode M4 to the post-restoration mode M3 (from S27 to S28 in FIG. 15).

In this embodiment, the restoring condition from the low electric power mode M4 was as follows. [Condition 1] Detection of sheet P by manual sheet feeding portion 203 based on setting of sheet P on manual sheet feeding portion (manual feeding tray) (FIG. 15: S27)

That is, detection of setting of the sheet P on the manual sheet feeding portion 23 by a manual sheet feeding portion 203 was a condition 1. For example, in the case where the operator sets the sheet(s) P on the manual sheet feeding portion 23 being in a state in which no sheet P is put, on the basis of a detection result of the manual sheet feeding portion 203, the manual sheet feeding portion 203 is capable of detecting that the state of the sheet P on the manual sheet feeding portion 23 changed from the absence (non-presence) state to the presence state.

A state in which the mode of the copying machine A is shifted from the low electric power mode 4 to the post-restoration mode M3 is different from a state in which the mode of the copying machine A is shifted from the image forming mode M1 to the stand-by mode M2. In the stand-by mode M2, each of the image forming units is in the image formation preparatory state so that the image can be formed immediately after the image forming signal is inputted to the engine controller 802, but in the post-restoration mode M3 from the low electric power mode, the fixing device 40 is maintained in the rest state. At this time, in the fixing device 40, the belt 100 and the pressing roller 101 are in the pressure-released state, and the heater 102 and the fixing motor 92 are in the non-operation state (non-energization state).

The reason why the fixing device 40 is in the rest state in the post-restoration mode M3 from the low electric power mode is as follows. As described above, in the stand-by mode M2, each image forming unit is on stand-by in the state in which the image formation can be started. Accordingly, in the case where the mode of the copying machine A shifts from the low electric power mode M4 to the stand-by mode M2, the image forming unit performs an initial operation for restoring to the image formation state. At this time, in the operation in the low electric power mode M4, the belt 100 and the pressing roller 101 are in the pressure-released state, and therefore, in the case of shifting to the stand-by mode M2, the state of the fixing device 40 changes from the pressure-released state to the press-contact state. However, there is also a possibility that the restoration of the state of the copying machine A from the state of the low electric power mode M4 is carried out for the purpose other than the image formation. In this embodiment, the purpose other than the image formation is, for example, original scanning and facsimile transmission based on data of the original. Further, for example, the purpose is the case where the sheet frequently used usually on the manual feeding tray is merely set on the manual feeding tray by the user and the image is not formed immediately. For these purposes, the image is not formed on the sheet P, and therefore, also the fixing device 40 is not used. Accordingly, in the case where the mode of the copying machine A is restored from the low electric power mode M4 for the purpose other than the image formation, the change in state of the fixing device 40 from the pressure-released state to the press-contact state is useless.

Thus, also in the case where the mode of the copying machine A might be restored from the low electric power mode M4 for the purpose other than the image formation, when the state of the fixing device 40 is changed from the pressure-released state to the press-contact state on each occasion, there is a liability that the change leads to a deterioration of a changing mechanism (for example, the cams 120). Therefore, in the copying machine A, in the case where the mode is restored from the low electric power mode M4, in which the fixing device 40 is in the pressure-released state, to the post-restoration mode M3 from the low electric power mode, as described below, the belt 100 and the pressing roller 101 are kept in the pressure-released state. Thereafter, when the mode is shifted to the image forming mode M1 or the stand-by mode M2, the state between the belt 100 and the pressing roller 101 is changed from the pressure-released state to the press-contact state by control of the CPU(ENG) 810.

Further, only under a condition such that a signal providing an image forming condition was inputted, the fixing device 40 was in the state in which the image formation was able to be started (i.e., the fixing process was able to be started). As soon as the image forming signal is inputted to the engine controller 802, the state of the copying machine A shifts to the image formation preparatory state capable of image formation.

In this embodiment, a condition for shifting the mode to a subsequent mode was as follows. The mode shifted by the following operation is either one of the image forming mode M1 and the stand-by mode M2. [Condition 2]: Pressing-down of copy start button 710 of operating portion 700 in state of screen after pressing-down of copy button 720 of touch panel 702 (Condition 3]: Pressing-down of respective setting buttons of screen after pressing-down of copy button 720 of touch panel 702

In [Condition 2] and [Condition 3], the copy button 720 is displayed on the touch panel 702.

When pressing-down of the copy start button 710 is inputted under the image forming condition of [Condition 2] described above, the mode shifts to the image forming mode. The fixing device 40 performs the press-contact operation of the fixing belt 100 and the pressing roller 101 by rotationally driving the fixing motor 92 in the motor reversing direction V which is the CCW direction. In order to perform the image forming operation after the press-contact, the heating member 102 is energized and the fixing motor 92 is rotationally driven in a motor reversing direction Y which is the CW (clockwise) direction (S17, S20, S21 and S23 in FIG. 14).

When pressing-down of respective setting buttons of screens after pressing-down of the copy button 720 is inputted under [Condition 3] described above, the mode shifts to the stand-by mode M2. That is, when the copy button 720 is pressed down, a screen displaying the respective setting buttons is displayed on the touch panel 702. When either of the respective setting buttons displayed on the screen after the copy button 720 is pressed down (i.e., when a predetermined instruction is inputted), the mode shifts to the stand-by mode M2. The fixing device 40 performs the press-contact operation of the belt 100 and the pressing roller 101 by rotationally driving the fixing motor 92 in the motor reversing direction V which is the CCW direction (S17, S20, S22 and S24 in FIG. 14).

In order to perform an initial stand-by operation as an image formation preparatory state after the press-contact, the heater 102 is energized and the fixing motor 92 is rotationally driven in the motor reversing direction Y which is the CW direction, so that the belt 100 and the pressing roller 101 are rotated and are placed in a preheating state. In the case where the image forming instruction is inputted during a shift to the preheating state, the mode is switched from the stand-by mode M2 to the image forming mode M1, and then the image forming operation is carried out (S25).

The feature of the image forming apparatus in this embodiment is summarized as follows. The image forming apparatus includes the image forming portion 10 for forming the toner image T on the recording material P and the fixing portion 40 including the pair of rotatable members 100 and 101 for heating the recording material P, on which the toner image T is formed by the image forming portion 10, while nipping and feeding the recording material P through the nip N formed between the rotatable members 100 and 101.

The image forming apparatus further includes the pressing mechanisms 118A and 118B for press-contacting the pair of rotatable members 100 and 101, the pressure-releasing mechanism 119 for releasing the press-contact between the pair of rotatable members 100 and 101 by the pressing mechanisms 118A and 118B, and the driving portions 91 and 92 for driving the pressure-releasing mechanism 119. Further, the image forming apparatus includes the controller (control unit) 800 for carrying out control of the operations of the driving portions 91 and 92 and control of the image forming portion 10 during the image formation.

Further, the image forming apparatus includes the manual feeding tray 23 for the recording material to be fed to the image forming portion 10. In a state during non-image formation, the image forming apparatus is operable in the low electric power mode in which the controller 800 is caused to be in the rest state for the purpose of reducing the electric power. When the mode shifts to the low electric power mode, in interrelation with the shift, the controller 800 is placed in the rest state while placing the pair of rotatable members 100 and 101 in the pressure-releasing state. Further, during the restoration from the low electric power mode, the state of the controller 800 is restored to the operable state while maintaining the pressure-releasing state of the pair of rotatable members 100 and 101.

Here, when the mode shifts to the low electric power mode, the control mode is not limited to the control mode such that the pressure between the pair of rotatable members 100 and 101 is released in interrelation with the shift, but may also be a control mode such that the pressure is released at a point of time after a lapse of a predetermined time (for example, 2 hours) after the shift to the low electric power mode.

The restoration from the low electric power mode is carried out on the basis of the setting of the recording material(s) on the manual feeding tray 23.

The copying machine A includes the operating portion 700 including the touch panel 702 for displaying the setting screen for original copy(ing) and including the original reading start button 710. The copying machine A switches the state of the pair of rotatable members 100 and 101 from the pressure-released state to the pressed state in response to the pressing-down of the original reading start button 710 in a state in which the setting screen is displayed on the touch panel 702 after the mode of the copying machine A is restored from the low electric power mode.

The copying machine A includes the operating portion 700 including the touch panel 702 for displaying the setting screen for original copy(ing) and including the original reading start button 710. The copying machine A switches the state of the pair of rotatable members 100 and 101 from the pressure-released state to the pressed state depending on the operation of the setting screen in a state in which the setting screen is displayed on the touch panel 702 after the mode of the copying machine A is restored from the low electric power mode.

That is, even when a trigger for restoring the mode from the low electric power mode is carried out, the pressing operation of the fixing portion is not carried out. Further, the copy screen is displayed on the operating portion, and the reading operation is not performed at a time other than the time when the setting button or the start key (button) is pressed down, so that an unnecessary pressing operation is avoided.

As described above, in the shift from the pressure-released state to the press-contact state (pressed state) after the restoration from the low electric power mode at the press-contact portion of the fixing portion, the pressure-released state is maintained under a condition other than the image forming condition. Further, the pressing mechanism is operated only when the press-contact is needed. As a result, the number of times of useless press-contact operation of the fixing device can be reduced.

Further, as described above, in the stand-by mode M2 in which the fixing device 40 is in the press-contact state, when the shift time to the low electric power mode M4 has elapsed, the mode shifts to the low electric power mode M4, so that the fixing device 40 is in the pressure-released state. In the case where the useless press-contact operation is performed during the restoration from the low electric power mode M4, there is a liability that the shift time has elapsed with no input of the image forming signal and the state of the fixing device 40 shifts to the pressure-released state again. Accordingly, as described above, by reducing the number of times of the useless press-contact operation during the restoration from the low electric power mode M4, the reduction also leads to a reduction in the number of times of a useless pressure-releasing operation. As a result, it is possible to provide an image forming apparatus including a fixing device capable of realizing a lifetime extension by suppressing deterioration of the pressing mechanism and its operation mechanism.

In this embodiment, as the fixing device 40, the endless rotatable member which is not stretched was used in the heater surface and the roller was used at the pressing side, but the fixing type is not limited to this fixing type. For example, a fixing type such that the endless rotatable member is used at the pressing side and a stretched endless rotatable member is used at the heater side may also be used.

Further, in this embodiment, as shown in FIG. 11, the pressure between the belt 100 and the pressing roller 101 is released, but the present invention is not limited thereto. When the press-contact trace is not left on the belt 100 and the pressing roller 101 at a pressure, the belt 100 and the pressing roller 101 may also be in a weak pressure contact state or the like. That is, in the above-described embodiment, the pressure-released state was described using, as an example, the case where the belt 100 and the pressing roller 101 are in a spaced state or in a contact state in which a contact pressure is zero, but the pressure-released state may also have the following constitution. A state in which the contact pressure at the nip N is smaller than the contact pressure in the press-contact state in which the nip N for fixing the toner image is formed between the belt 100 and the pressing roller 101 (i.e., in which the pressure is smaller than the pressure in the press-contact state) may also be used as the pressure-released state.

In the above, description was made using, as an example, the case where a device (apparatus) for heating and fixing the unfixed toner image formed on the sheet was used as the fixing device, but the present invention is not limited thereto. For example, a device for increasing a gloss (glossiness) of an image by fixing the toner image temporarily fixed on the sheet (also in this case, the device is referred to as the fixing device) may also be used.

The heating means for heating the rotatable member is not limited to the ceramic heater used in the above-described embodiment. A device constitution using a heating device, of an internal heating type or external heating type, such as an electromagnetic induction heating means, a halogen heater, an infrared lamp or a nichrome wire heater can also be employed.

The image forming apparatus is not limited to the full-color image forming apparatus of the electrophotographic type, but may also be an image forming apparatus for forming a monochromatic image. Further, the present invention is not limited to the image forming apparatus of the electrophotographic type, but may also be an image forming apparatus for forming the toner image by using another type such as an electrostatic recording type or a magnetic recording type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2016-200027 filed on Oct. 11, 2016, and 2017-146382 filed on Jul. 28, 2017, which are hereby incorporated by reference herein in their entirety.

What is claimed is:

1. An image forming apparatus comprising:

a manual feeding tray;

a detecting portion configured to detect whether or not a sheet is put on said manual feeding tray;

an image forming portion configured to form an image on the sheet fed from said manual feeding tray;

a first rotatable member;

a second rotatable member configured to form a nip, for fixing the image on the sheet, in cooperation with said first rotatable member;

a pressing mechanism configured to press said first rotatable member toward said second rotatable member;

a moving mechanism configured to move said pressing mechanism between a first position where the nip is formed by said first and second rotatable members and a second position where said first and second rotatable members are spaced from each other;

a control unit configured to control an operation of said moving mechanism; and a receiving portion configured to receive input of an instruction about an image forming operation for forming the image on the sheet by said image forming portion, wherein said image forming apparatus is capable of selectively executing one of operations in a plurality of modes including a first mode in which said control unit is in a rest state and a second mode in which electric power is supplied to said control unit, and wherein said image forming apparatus changes the mode of the operation to the second mode of the operation in response to detection of putting of the sheet on said manual feeding tray during execution of the operation in the first mode with said pressing mechanism being in the second position, and then in response to receipt of input of a predetermined instruction about the image forming operation by said receiving portion during execution of the operation in the second mode, said control unit controls said moving mechanism so that said pressing mechanism moves from the second position to the first position.

2. An image forming apparatus according to claim 1, wherein said receiving portion includes a display portion and a display controller configured to control display of said display portion, and wherein said display controller displays a setting screen of the image forming operation at said display portion in response to input, from an operator, of an instruction to display the setting screen, and the setting screen is a screen through which the predetermined instruction is capable of being inputted.

3. An image forming apparatus according to claim 1, further comprising a reading portion configured to read an image of an original, wherein the predetermined instruction is an instruction of a start of reading, by said reading portion, of the image of the original.

4. An image forming apparatus according to claim 1, wherein said image forming apparatus is capable of executing an operation in a third mode in which electric power is supplied to said control unit and said pressing mechanism is in the first position, and wherein in interrelation with a change in mode of the operation executed by said image forming apparatus from the third mode to the second mode, said control unit controls said moving mechanism so that said pressing mechanism is in the second position.

5. An image forming apparatus according to claim 1, wherein said image forming apparatus is capable of executing an operation in a third mode in which electric power is supplied to said control unit and said pressing mechanism is in the first position, wherein said receiving portion is capable of receiving input of an instruction of a change in mode of the operation from the third mode to the second mode, and wherein in response to reception of the input, by said receiving portion, of the instruction of the change in mode of the operation from the third mode to the second mode, said control unit controls said moving mechanism so that said pressing mechanism is in the second position.

6. An image forming apparatus comprising:

a manual feeding tray;

a detecting portion configured to detect whether or not a sheet is put on said manual feeding tray;

an image forming portion configured to form an image on the sheet fed from said manual feeding tray;

a first rotatable member;

a second rotatable member configured to form a nip, for fixing the image on the sheet, in cooperation with said first rotatable member;

a pressing mechanism configured to press said first rotatable member toward said second rotatable member;

a moving mechanism configured to move said pressing mechanism between a first position where the nip is formed by said first and second rotatable members and a second position where a force applied between said first and second rotatable members by said pressing mechanism is smaller than that when said pressing mechanism is in the first position;

a control unit configured to control an operation of said moving mechanism; and a receiving portion configured to receive input of an instruction about an image forming operation for forming the image on the sheet by said image forming portion, wherein said image forming apparatus is capable of selectively executing one of operations in a plurality of modes including a first mode in which said control unit is in a rest state and a second mode in which electric power is supplied to said control unit, and wherein said image forming apparatus changes the mode of the operation to the second mode of the operation in response to detection of putting of the sheet on said manual feeding tray during execution of the operation in the first mode with said pressing mechanism being in the second position, and then in response to receipt of input of a predetermined instruction about the image forming operation by said receiving portion during execution of the operation in the second mode, said control unit controls said moving mechanism so that said pressing mechanism moves from the second position to the first position.

7. An image forming apparatus according to claim 6, wherein said receiving portion includes a display portion and a display controller configured to control display of said display portion, and wherein said display controller displays a setting screen of the image forming operation at said display portion in response to input, from an operator, of an instruction to display the setting screen, and the setting screen is a screen through which the predetermined instruction is capable of being inputted.

8. An image forming apparatus according to claim 6, further comprising a reading portion configured to read an image of an original, wherein the predetermined instruction is an instruction of a start of reading, by said reading portion, of the image of the original.

9. An image forming apparatus according to claim 6, wherein said image forming apparatus is capable of executing an operation in a third mode in which electric power is supplied to said control unit and said pressing mechanism is in the first position, and wherein in interrelation with a change in mode of the operation executed by said image forming apparatus from the third mode to the second mode, said control unit controls said moving mechanism so that said pressing mechanism is in the second position.

10. An image forming apparatus according to claim 6, wherein said image forming apparatus is capable of executing an operation in a third mode in which electric power is supplied to said control unit and said pressing mechanism is in the first position, wherein said receiving portion is capable of receiving input of an instruction of a change in mode of the operation from the third mode to the second mode, and wherein in response to reception of the input, by said receiving portion, of the instruction of the change in mode of the operation from the third mode to the second mode, said control unit controls said moving mechanism so that said pressing mechanism is in the second position.

* * * * *